US005119716A

United States Patent [19]

Bartolles

[11] Patent Number: 5,119,716

[45] Date of Patent: Jun. 9, 1992

[54] MUZZLE BRAKE FOR A LARGE CALIBER TUBULAR WEAPON

[75] Inventor: Rolf Bartolles, Korschenbroich, Fed. Rep. of Germany

[73] Assignee: Rheinmetall GmbH, Dusseldorf, Fed. Rep. of Germany

[21] Appl. No.: 723,062

[22] Filed: Jun. 28, 1991

[30] Foreign Application Priority Data

Aug. 11, 1990 [DE] Fed. Rep. of Germany ..... 4025546

[51] Int. Cl.[5] ..... F41A 21/34

[52] U.S. Cl. ..... 89/14.3; 89/14.4

[58] Field of Search ..... 89/14.2, 14.3, 14.4, 89/14.5

[56] References Cited

U.S. PATENT DOCUMENTS

| | | | |
|---|---|---|---|
| 1,363,058 | 12/1920 | Schneider | 89/14.3 |
| 2,143,596 | 1/1939 | Gallot et al. | 89/14.3 |
| 3,141,376 | 7/1964 | Chinn | 89/14.3 |
| 4,545,285 | 10/1985 | McLain | 89/14.3 |
| 4,562,767 | 1/1986 | Janssen et al. | 89/14.3 |

FOREIGN PATENT DOCUMENTS

| | | | |
|---|---|---|---|
| 0958162 | 3/1950 | France | 89/14.3 |
| 0454533 | 10/1936 | United Kingdom | 89/14.3 |

OTHER PUBLICATIONS

"Militärtechnik" (Military Technology), No. 6/74, p. 250.

W. Beitz et al, "Dubbel Taschenbuch für den Maschinenbau" [Dubbel Handbook for Machine Construction], 15 Ed., p. 1399.

*Primary Examiner*—David H. Brown

*Attorney, Agent, or Firm*—Spencer, Frank & Schneider

[57] ABSTRACT

A muzzle brake (10) for a gun barrel (12) to be attached coaxially onto the muzzle end of the gun barrel up to a radially extending annular abutment surface (20) and provided with elongated gas discharge openings (14) which are arranged transversely to the axis of the bore (16) over its lateral effective length region ($L_2$) and have a minimum opening length ($L_1$) at the rear of the effective length of the muzzle brake (10), i.e., adjacent the position of the abutment surface (20), the axial inner bore (18) of the muzzle brake (10) has an inner diameter (d) which corresponds to the rifling diameter ($d_1$) of the gun barrel (12) and its rear end ends at the radially extending abutment surface. The gas discharge openings (14) are provided with rearwardly sloped baffles (24) and gas guide surfaces (26) which have different lengths in the rear region of the muzzle brake (10) and have the same opening length ($L_1$) in the forward region. The rear end of the muzzle brake (10) where it encloses the gun barrel (12) is connected with the gun barrel (12) by a separate tensioning device (22) and can be given a defined pretension. The tensioning device (22) exerts a high tractive force on the rear end of the muzzle brake (10) so that the abutment surface (20) lies sealingly pressed against the end surface (38) of the gun barrel muzzle.

20 Claims, 1 Drawing Sheet

PRIOR ART

MUZZLE BRAKE FOR A LARGE CALIBER TUBULAR WEAPON

BACKGROUND OF THE INVENTION

The present invention relates to a muzzle brake for a gun barrel. More particularly, the present invention relates to a muzzle brake which is attached coaxially onto the muzzle end of a gun barrel up to a radially extending annular abutment, and which is provided with gas discharge openings arranged transversely to the axis of the bore over its lateral length region and having a minimum opening length at the rear end of the muzzle brake.

A muzzle brake of the above type is disclosed in "Militärtechnik" (Military Technology), No. 6/74, page 250, FIGS. 4 and 5. This publication discloses gas discharge openings which have a forward deflecting surface, or baffle, and a rearward guide surface which are parallel and are oriented at an undefined angle obliquely toward the rear. No mention is made as to which angular range of the baffle causes the maximum reduction of the recoil energy of a gun barrel to be realized during the firing of a spin stabilized projectile. This publication also discloses the arrangement of the gas discharge openings in positions transverse to the axis of the gun barrel with different lengths from the rear end of the effective portion of muzzle brake in an ascending manner up to the very front. In this way it is possible, on the one hand, to reduce the sound pressure and the muzzle flash, but, on the other hand, the recoil energy of the gun barrel is reduced in an unfavorable manner.

Additionally, this muzzle brake does not have a through-going internal bore but has widened portions in the region of the discharge openings which go beyond the inner diameter of the barrel. During passage of a projectile, the gas pressure existing in the region of the widened portions is reduced very quickly within the gun barrel so that no further, or possibly only a very slight, increase in the velocity of the projectile can be realized in the effective region of the muzzle brake.

When employed in a large-caliber gun barrel, the above-described muzzle brake still requires an additional stable securing mechanism. It may be secured against rotation, similarly to the muzzle brake disclosed in German published patent application No. DE 3,203,807 Al, corresponding to U.S. Pat. No. 4,562,767, by a key engaging in the groove in the gun barrel in the region of the thread portion enclosing the gun barrel, with the muzzle brake previously having been tensioned by a locknut as shown in FIG. 1 of the present application and the key having been secured in a complicated manner against radial loosening.

However, the process of tensioning the locknut pushes the threaded portion forward within its tolerance range so that a gap is created between the forward end surface of the gun barrel and the radial stop surface of the muzzle brake. Through this gap, various materials, for example propellant gases and moisture, may adversely influence the service life of an inserted elastomer seal, which may result in consequential damage due to corrosion in the fastening region of the muzzle brake.

SUMMARY OF THE INVENTION

In contrast thereto, it is an object of the present invention to make available a muzzle brake which not only is improved in efficiency compared to the above cited muzzle brake but also increases the initial velocity of a projectile.

The above object is generally achieved according to the present invention by a muzzle brake to be attached coaxially to the muzzle end of a rifled gun barrel which comprises a tubular member having an axial bore and including a rear portion wherein the axial bore has of a first diameter to fit over and center the muzzle brake on the outer circumferential surface of the muzzle end of a gun barrel, and a front portion wherein the axial bore has a reduced second diameter corresponding to the rifling diameter of the gun barrel so that a radially extending annular abutment surface is formed within the member between the front and rear portions a plurality of elongated gas discharge openings formed in the front portion of the member and disposed along the length of the front portion, with the gas discharge openings having their respective lengths extending transverse to the bore axis of the muzzle brake and having a minimum length adjacent the abutment surface, different lengths in a rear region of the front portion, and the same lengths in a forward region of the front portion, and with each of the gas discharge openings having front and rear edges defined by a rearwardly sloped baffle and a rearwardly sloped gas guide surface, respectively; and tensioning means, connected to a rear end surface of the muzzle brake and connectable to the outer circumferential surface of a gun barrel, for exerting a defined high tractive force to the rear end of the muzzle brake to cause the abutment surface to abut and sealingly engage the end surface of a gun barrel muzzle.

The muzzle brake according to the invention, particularly when employed in large caliber tubular weapons, for example in the gun barrels of field or armored howitzers, results in significant advantages. Due to the fact that the axial internal bore of the front or effective portion of the muzzle brake has an interior diameter which corresponds to the diameter of the rifling in the gun barrel and ends at its rear radially extending abutment surface, fewer gases are able to flow laterally past the projectile during its passage through the muzzle brake so that the reduction of gas pressure remains comparatively low within the muzzle brake and it is possible to raise the initial projectile velocity by, for example, 20 m/sec.

Starting from the diameter of the rifling, the lateral gas discharge openings have different lengths which increase considerably in the forward direction, while the gas discharge openings in the forward region of the muzzle brake front portion all have the same length. The comparatively short length of the openings in the first, rear passage phase of the projectile through the effective portion of the muzzle brake results in a reduction of the sound pressure and of the muzzle flash, while the flow of gases over the full increased length of the slits (or openings) against the baffles in the second, forward passage phase of the projectile through the muzzle brake results in decelerating the recoil energy of the gun barrel with great efficiency to, for example, 50%. The high efficiency is realized, for example, if the angle of the baffle falls into an angle range between 100° and 105° relative to the internal bore, i.e., the bore axis, and the angle of the gas guide surface falls into an angle range between 110° and 120° relative to the internal bore.

The rear end of the muzzle brake according to the present invention is connected by a separate tensioning device with the muzzle end of the gun barrel where it surrounds the gun barrel and can be positively pre-tensioned, with the tensioning device exerting a high tractive force on the rear end of the muzzle brake so that the radial abutment surface is pressed sealingly against the end surface of the gun barrel muzzle. The sealing contact of the abutment surface of the muzzle brake at the end surface of the gun barrel prevents the propellant gases flowing out of the gun barrel and the entrance of moisture, thereby preventing corrosion damage in the fastening region. Thus the muzzle brake is also easily dismountable and mountable.

According to one feature of the invention, the tensioning device is composed of an annular flange connected to the gun barrel which permits the use of small dimension, high strength screws which are self tightening and can be pre-tensioned to a high degree. Thus the screws produce, in a simple manner, a high pressure per surface area and thus the desired sealing effect between the interior annular abutment surface of the muzzle brake and the end surface of the gun barrel.

Based on the known state of the art, the invention will be described below in greater detail with reference to an embodiment thereof that is illustrated in the drawing figures.

DETAILED DESCRIPTION OF THE PREFERRED EMBODIMENTS

Figure 1:
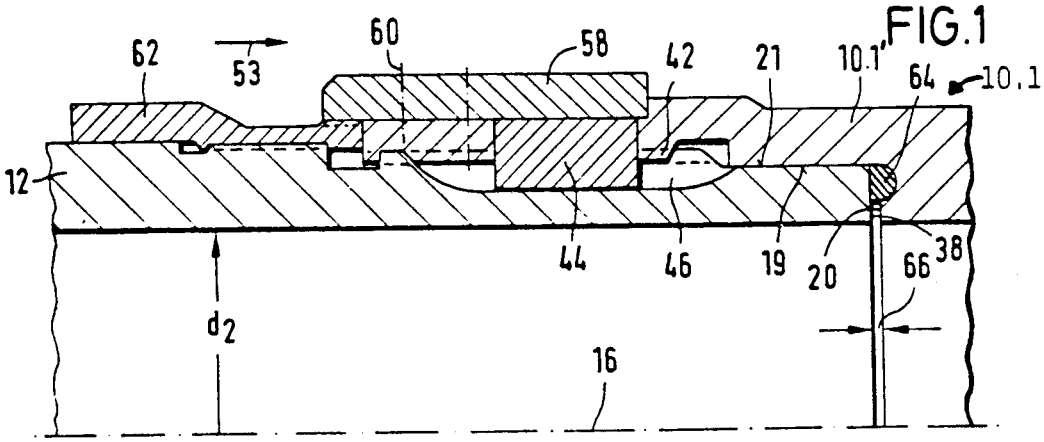
FIG. 1 is a sectional view of the fastening region of a prior art muzzle brake and a large caliber gun barrel by means of conventional fastening elements.

FIG. 1 shows the forward end of a large caliber gun barrel 12, for example, having a caliber diameter $d_2$ of 155 mm, which accommodates a muzzle brake 10.1 on its exterior in a known manner. Muzzle brake 10.1 is attached to the muzzle end of gun barrel 12 coaxially with the axis 16 of the gun barrel so that it generally abuts the muzzle end surface 38 of the barrel 12 at a radially inwardly extending annular stop or abutment surface 20, and includes an internal thread 42 which, in order to fasten the muzzle brake 10.1 to the gun barrel, can be screwed onto a corresponding external thread on gun barrel 12. A key 44 engaging in a groove 46 in the surface of gun barrel 12 secures the muzzle brake 10.1 against rotation.

To prevent muzzle brake 10.1 from axially moving within the play of the thread 42 during firing operations, muzzle brake 10.1 is held in a defined position by a locknut 62. Locknut 62 is connected by a thread with gun barrel 12 behind muzzle brake 10.1, and, when applied, pushes muzzle brake 10.1 in the forward direction 53 which, however, loosens the contact between stop surface 20 of muzzle brake 10.1 and the end surface 38 of gun barrel 12, leaving a gap 66. This may create the above-mentioned drawbacks and, for example, hot propellant gases and powder residues may destroy the elastomer seal 64 disposed between the end surface 38 and the muzzle brake to seal gap 66, while additionally causing corrosion damage from water and moisture at the larger diameter centering bore 19 of the rear portion 10.1' of muzzle brake 10.1 and at the centering cylinder 21 of gun barrel 12 and possibly at the fastening thread 42. In this prior art manner of fastening the muzzle brake 10.1, the locknut 62 requires an additional securing element 58 which is fastened by screws 60 to muzzle brake 10.1 in order to secure the locknut 62 against rotation and the key 44 against radial removal.

In contrast thereto, FIGS. 2 to 5, wherein the same parts shown in FIG. 1 are given the same reference numerals, show the configuration and fastening of a muzzle brake 10 according to the present invention to the forward end of a gun barrel 12.

Figure 2:
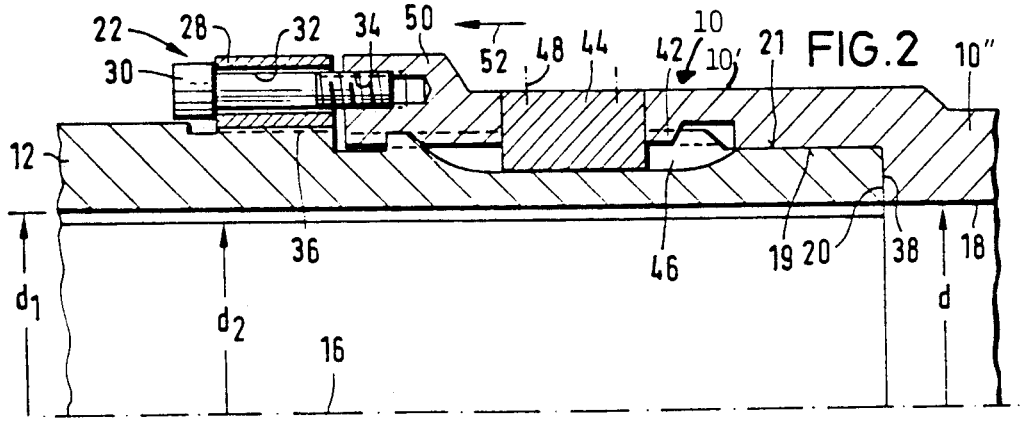
FIG. 2 is a sectional view of the fastening region of the muzzle brake according to the present invention and a large caliber gun barrel.

According to FIG. 2, the rear end of muzzle brake 10 is connected with gun barrel 12 by a separate tensioning device 22 which surrounds gun barrel 12 and can be given a defined pre-tension. Tensioning device 22 exerts a strong tractive force on the rear end of muzzle brake 10 so that stop or abutment surface 20 of muzzle brake 10 is pressed sealingly against the end surface 38 of the muzzle end of the gun barrel 12.

The tensioning device 22 is composed of an annular flange 28 connected with gun barrel 12 and provided with axially extending throughbores 32 to accommodate screws 30, while the rear larger inner diameter portion 10' of muzzle brake 10 is provided with a cylindrical extension 50 provided at its frontal or end surface with a plurality of axially extending threaded bores 34 for receiving and fastening of the screws 30. Screws 30 of tensioning device 22 are made of a high strength material, preferably steel, having a minimum tensile strength of 1200 $N/mm^2$. In a space saving manner, flange 28 preferably is axially positioned on and connected to gun barrel 12 by a fine thread 36.

Despite their space saving dimensions, high strength screws 30 can be stressed highly and thus their high pre-stressing force acts as a self-securing means so that additional screw-type securing means can be omitted. The high tractive strength of screws 30 acting in the rearward direction 52 is transferred in a supporting manner from the stop 20 of muzzle brake 10 to the forward end surface 38 of gun barrel 12, thus generating a specific pressure per unit area of, for example, 200 $N/mm^2$ and a good direct sealing effect between the abutment surface or stop 20 and the barrel end surface 38, particularly also against a gas pressure of 800 bar existing during the firing process. The centering surfaces 19 and 21 and thread 42 are thus protected against corrosion damage, with the use of the known sealing ring 64 being unnecessary. As in the past, muzzle brake 10 may also be secured against rotation by a key 44 which is secured to the muzzle brake 10, e.g., by a schematically shown fastening device 48, and which extends into the groove 46. According to an embodiment (not shown here) the tensioning device according to the present invention even permits, due to its high pre-tension, the omission of thread 42 and key 44 with groove or keyway 46.

Figure 3:
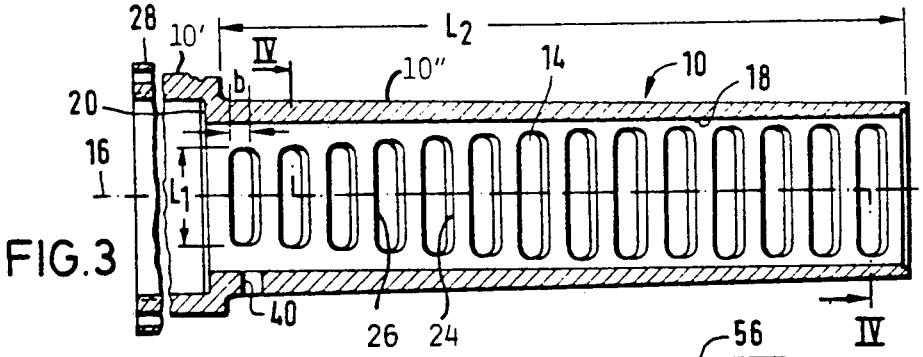
FIG. 3 is a longitudinal sectional view of the muzzle brake according to the invention.
Figure 5:
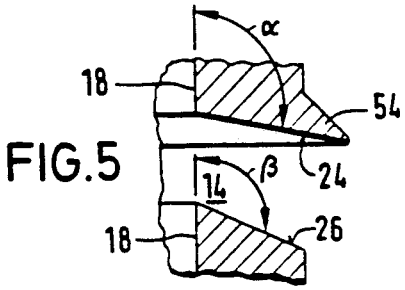
FIG. 5 is a sectional view seen along the line marked V—V in FIG. 4.
Figure 4:
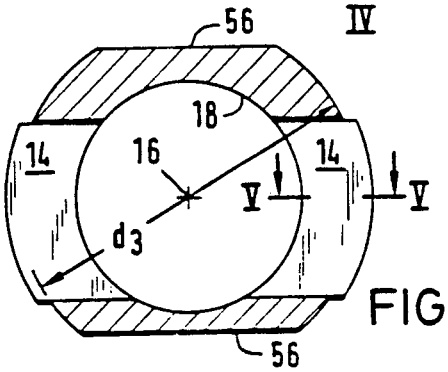
FIG. 4 is a cross-sectional view seen along the line marked IV—IV in FIG. 3.

FIGS. 3 to 5 show the elongated gas discharge openings 14 which are arranged in the lateral length region of the front portion 10'' of muzzle brake 10 to extend transverse to the bore axis 16, and with the rear gas discharge opening 14 having a minimum opening length $L_1$.

The axial internal bore 18 of the front portion 10'' of muzzle brake 10 has an internal diameter d (see FIG. 2)

which corresponds to the rifling diameter $d_1$ (see FIG. 2) and not the caliber diameter $d_2$ of gun barrel 12 (as in FIG. 1), with the rear end of the bore 18 ending at the radially extending abutment surface or stop 20. This embodiment realizes the advantage that, in addition to the mentioned increase in the initial projectile velocity, the number of projectile revolutions in the region of the front portion of muzzle brake 10 is no longer increased, thus avoiding additional stresses on the projectile.

Beginning at the rear of the front portion 10'' of muzzle brake 10, i.e. in the region with the rifling diameter d, the elongated gas discharge openings 14 are provided with rearwardly inclined or sloped baffles 24 and gas guide surfaces 26 which define the forward and rear edges respectively of the respective openings 14. As shown, the openings 14 in the rear region of muzzle brake portion 10'' have different lengths $L_1$ and the openings 14 in the forward region have the same length $L_1$, with the width b of the openings 14 always being constant. Preferably, opening lengths $L_1$ increase regularly up to one-half the effective length $L_2$ of muzzle brake 10, i.e., the length of the front portion 10'', and then remain constant in the subsequent half of length $L_2$. The angle o of the baffles 24 and the angle $\beta$ of the gas guide surfaces 26 relative to the interior bore 18, i.e., relative to the bore axis 16, in the forward direction have different respective slopes.

The angle $\alpha$ of baffles 24 ensures optimum deflection of the exiting gases over an angle range from 100° to 105° relative to internal bore 18 and, in cooperation with gas discharge openings 14 of the maximum opening length $L_1$ in the front half of the effective layer $L_2$, reduce the recoil energy of gun barrel 12 by 50%. In a gun barrel 12 having a caliber diameter $d_2$ of 155 mm, for example, the recoil energy can be reduced from 1200 kN to 600 kN.

The angle $\beta$ of gas guide surfaces 26 provides for proper gas discharge over an angle range from 110° to 120°. A particularly favorable braking effect for gun barrel 12 is realized if baffle 24 is arranged at an angle $\alpha$ of 102° and gas guide face 26 is arranged at an angle $\beta$ of 114° relative to internal bore 18 or bore axis 16, with baffle 24 possibly being made even larger by giving it an attachment 54 which goes beyond the outer diameter $d_3$ of the muzzle brake.

Muzzle brake 10 is further distinguished by being structurally short, with the ratio of the effective length $L_2$ of muzzle brake 10, i.e., the length of the forward portion 10'', to the caliber diameter $d_2$ of gun barrel 12 being between four and five. Over this effective length $L_2$, muzzle brake 10 is provided with a large number of gas discharge openings 14, for example, fourteen gas discharge openings 14 on each side.

The short structural length $L_2$ of muzzle brake 10 and a flattened portion 56 disposed at the top and bottom of the muzzle brake 10 over its entire length region $L_2$ has a weight reducing effect and thus a positive effect with respect to the pre-tensioning forces to be exerted by the tensioning device 22.

In order to prevent the accumulation of moisture and water in gun barrel 12, the muzzle brake is provided with a drain opening 40 which is preferably disposed in the lower rear region of the front portion 10'' of muzzle brake 10.

The invention now being fully described, it will be apparent to one of ordinary skill in the art that any changes and modifications can be made thereto without departing from the spirit or scope of the invention as set forth herein.

What is claimed is:

1. A muzzle brake to be attached coaxially to the muzzle end of a rifled gun barrel comprising: a tubular member having an axial bore and including a rear portion wherein said axial bore has a first diameter to fit over and center said muzzle brake on the outer circumferential surface of the muzzle end of a gun barrel, and a front portion wherein said axial bore has a reduced second diameter corresponding to the rifling diameter of the gun barrel so that a radially extending annular abutment surface is formed within said member between said front and rear portions; a plurality of elongated gas discharge openings formed in said front portion of said member and disposed along the length of said front portion, said gas discharge openings having their respective lengths extending transverse to the bore axis of said muzzle brake and having a minimum length adjacent said abutment surface, different lengths in a rear region of said front portion, and the same lengths in a forward region of said front portion, each of said gas discharge openings having front and rear edges defined by a rearwardly sloped baffle and a rearwardly sloped gas guide surface respectively; and tensioning means, connected to a rear end of said muzzle brake and connectable to the outer circumferential surface of a gun barrel, for exerting a defined high tractive force to said rear end of said muzzle brake to cause said abutment surface to abut and sealingly engage the end surface of a gun barrel muzzle.

2. A muzzle brake as defined in claim 1, wherein said opening lengths of the respective said gas discharge openings increase constantly from said minimum length for approximately one-half of the length of said front portion of said muzzle brake and then remain constant over the subsequent one-half of said length of said front portion.

3. A muzzle brake as defined in claim 1 wherein the length of said front portion of said muzzle brake relative to the caliber diameter of an associated gun barrel lies in a ratio of between 4 and 5.

4. A muzzle brake as defined in claim 1 wherein said front portion of said muzzle brake is provided with respective flattened portions at the top and bottom which extend over the entire length thereof.

5. A muzzle brake as defined in claim 1 wherein a drain opening is provided in the lower rear region of said first portion of said muzzle brake.

6. A muzzle brake as defined in claim 1 wherein said plurality of gas discharge openings are symmetrically disposed in pairs on opposite sides of said front portion of said muzzle brake, have their respective lengths extending parallel to one another, and are all of a constant width.

7. A muzzle brake as defined in claim 1, wherein: said tensioning means comprises an annular flange having means for connecting said flange to the outer surface of a gun barrel, said flange being provided with a plurality of axially extending throughbores for accommodating respective screws; and said rear end surface of said muzzle brake is provided with threaded axial bores for receiving and fastening said screws.

8. A muzzle brake as defined in claim 7 wherein said screws of said tensioning means are made of a high strength material having a minimum tensile strength of 1200 $n/mm^2$.

9. A muzzle brake as defined in claim 7 wherein said means for connecting said flange with a gun barrel comprises a fine thread disposed on an inner surface of said annular flange.

10. A muzzle brake as defined in claim 1, wherein said baffles and said gas guide surfaces have different respective slope angles relative to said bore axis.

11. A muzzle brake as defined in claim 10, wherein said slope angle ($\alpha$) of said baffles relative to said bore axis in the forward direction is in an angle range between 100° and 105° and said slope angle ($\beta$) of said gas guide surfaces relative to said bore axis in the forward direction is in an angle range between 110° and 120°.

12. A muzzle brake as defined in claim 11, wherein said baffles are disposed at a said slope angle ($\alpha$) of 102° and said gas guide surfaces are disposed at a said slope angle ($\beta$) of 114° relative to said bore axis.

13. In combination with a rifled gun barrel, a muzzle brake attached coaxially to a muzzle end of said gun barrel and comprising: a tubular member having an axial bore and including a rear portion which extends coaxially over and centers said muzzle brake on an outer circumferential surface of said muzzle end of said gun barrel, and a front portion wherein said axial bore has a reduced diameter corresponding to the rifling diameter of said gun barrel so that a radially extending annular abutment surface is formed within said member between said front and rear portions; a plurality of elongated gas discharge openings formed in said front portion and disposed along the length of said front portion, said gas discharge openings having their respective lengths extending transverse to the bore axis of said muzzle brake and having a minimum length adjacent said abutment surface, different lengths in a rear region of said front portion, and the same lengths in a forward region of said front portion, and each of said gas discharge openings having front and rear edges defined by a rearwardly sloped baffle and a rearwardly sloped gas guide surface respectively; and, tensioning means connected between said surface of said gun barrel and a rear end surface of said muzzle brake, for exerting a defined high tractive force to said rear end of said muzzle brake to cause said abutment surface to abut and sealingly engage the end surface of said gun barrel muzzle.

14. Apparatus as defined in claim 13 wherein said opening lengths of said gas discharge openings increase constantly from said minimum length over one-half of the length of said front portion of said muzzle brake, and then remain constant over the subsequent one-half of said length of said front portion.

15. Apparatus as defined in claim 13 wherein the length of said forward portion of said muzzle brake relative to the caliber diameter of said gun barrel lies in a ratio of between 4 and 5.

16. Apparatus as defined in claim 13, wherein said baffles and said gas guide surfaces have different respective slope angles relative to said bore axis.

17. Apparatus as defined in claim 16, wherein said slope angle ($\alpha$) of said baffles relative to said bore axis in the forward direction is in an angle range between 100° and 105° and said slope angle ($\beta$) of said gas guide surfaces relative to said bore axis in the forward direction is in an angle range between 110° and 120°.

18. Apparatus as defined in claim 13 wherein said tensioning means comprises: an annular flange connected to said surface of said gun barrel and provided with a plurality of axially extending throughbores; respective screws disposed in said throughbores; and a plurality of threaded axial bores disposed in said rear end surface of said muzzle brake and receiving and fastening respective said screws.

19. Apparatus as defined in claim 18 wherein said screws of said tensioning means are made of a high strength material having a minimum tensile strength of 1200 n/mm.

20. Apparatus as defined in claim 18 wherein said flange is connected with said surface of said gun barrel by a fine thread.

* * * * *